United States Patent [19]

Köbel et al.

[11] Patent Number: 4,609,033

[45] Date of Patent: Sep. 2, 1986

[54] APPARATUS FOR COMPACTING FOUNDRY MOLD MAKING MATERIALS

[75] Inventors: Alfons Köbel, Karlsruhe; Norbert Damm, Karlsdorf; Werner Geiger, Pfinztal; Günter Müller, Karlsruhe, all of Fed. Rep. of Germany

[73] Assignee: BMD Badische Maschinenfabrik Durlach GmbH, Karlsruhe, Fed. Rep. of Germany

[21] Appl. No.: 736,261

[22] Filed: May 21, 1985

Related U.S. Application Data

[62] Division of Ser. No. 453,093, Dec. 27, 1982, Pat. No. 4,529,026.

[30] Foreign Application Priority Data

Dec. 28, 1981 [DE] Fed. Rep. of Germany ..... 3151645
Feb. 20, 1982 [DE] Fed. Rep. of Germany ..... 3206208

[51] Int. Cl.[4] ..... B22C 15/00
[52] U.S. Cl. ..... 164/169; 164/15
[58] Field of Search ..... 164/169, 159, 37, 38, 164/195, 12, 15

[56] References Cited

U.S. PATENT DOCUMENTS 3,659,642 5/1972 Vasilkovskey et al. ..... 164/169

FOREIGN PATENT DOCUMENTS 2069384 8/1981 United Kingdom ..... 164/169
1006042 3/1983 U.S.S.R. ..... 164/169

*Primary Examiner*—Nicholas P. Godici
*Assistant Examiner*—Samuel M. Heinrich

[57] ABSTRACT

In a process for compacting foundry mold making material, that is loosely heaped in a closed mold space over a pattern, the surface of the material is acted on by a compressed gas with a pressure of at the most 8 bar. This gas is caused to undergo expansion out of an inlet space through a valve in an opening at a gas flow rate of over 50 kg/sec and with a pressure increase rate of over 300 bar/sec, into the mold space. The maximum pressure in the inlet space or antichamber is 20 bar. An apparatus for use in the method is made up of a pressure vessel, a mold flask placed thereunder having a filling frame and a pattern plate. The opening cross section of the valve is 50 to 150% of the horizontal cross section of the mold flask and is opened in a short time of the order of milliseconds.

39 Claims, 11 Drawing Figures

APPARATUS FOR COMPACTING FOUNDRY MOLD MAKING MATERIALS

This is a division of application Ser. No. 453,093, filed Dec. 27, 1982, now U.S. Pat. No. 4,529,026.

BACKGROUND OF THE INVENTION

The present invention is with respect to a process an apparatus for compacting foundry mold-making material, that is filled into a closed mold space loosely over a pattern, using a compressed gas acting on the surface of the mold-making material and which undergoes expansion out of a high-pressure inlet space through an opening, that is able to be shut, into and in the mold space.

For compacting foundry mold-making materials a number of different methods, that are of a mechanical, pneumatic or of a mixed mechanical-pneumatic nature, have been put forward in the prior art. The present invention is however limited to pneumatic processes. Such processes may be put into two groups, that is to say a first group in which mold material is put under pressure in an inlet space and, on opening a valve, is blown or blasted together with the air into the mold space. In this process however a later mechanical pressing operation on the mold material is necessary each time in the flask using a high pressing force, the German Auslegeschrift specification No. 2,844,464 for example being representative of such a method. In the other group the mold material is loosely heaped onto the pattern and then acted upon by compressed air from the back of the mold. Examples of such a method are to be seen in the German Auslegeschrift specification Nos. 2,844,464 and 1,961,234.

This second group or family of methods, may for its part be thought of as two different lines of development. In the one line (see the said German specification No. 2,844,464) compressed air from the plant air line is blown at a pressure of up to 7 bar for between 0.2 and 1 second one or more times through openings in a hollow end plate of the mold space with the purpose of causing the air to make its way out again through openings in the pattern plate after flowing through the foundry sand. In this case as well later ones mechanical pressing is necessary for compacting the back of the mold on the one hand and on the other hand for clearing any air that is still present in the mold material and which was taken up therein because of the fluidizing effect. This mechanical pressing is supported by the use of vacuum as well. The plant is not made simpler to any marked degree than plants based on the use of blasting or blowing operations.

In the other line of this family of prior art process developments, see German specification No. 1,961,234, operation takes place in a high pressure range, that is to say, the pressure in the inlet space is very much greater than the line pressure in a foundry of up to 7 bar. In this known process the inlet pressure to be used is in fact between 20 and 100 bar, and the air at this pressure undergoes expansion within a time of at the most 0.15 second, so that it is then possible to do without the otherwise necessary further pressing step. A further condition necessary for running the process with the desired effect is that of having a certain ratio between the gas throughput rate on the one hand and the amount of the mold making material on the other, that is to say so as to have a ratio of between 5:1 and 40:1, such ratio furthermore being controlling for and giving a relation between the gas flow rate and the size of the mold flask. The said German specification No. 1,961,234 furthermore has a mold making machine in which there is a pressure vessel forming the inlet space or anti-chamber over the closed flask or over a filling frame that is put on top of it. There is a mechanically worked valve for joining the inlet space with the mold space. For the purpose of obtaining a reasonable overall size of apparatus using mold flasks of the standard size, a feed pressure of 100 bar was to be used in order to get the desired degree of compaction after expansion into the mold space. However such high pressure is likely to be the cause of an uneven surface of the molding material when the compressed gas violently takes effect on the back of the mold and the plant is made very much more complex in view of the need for producing such high pressures and making the structure walling in the mold space pressure-resistant enough. It would seem to be in view of this fact that there has been the further suggestion in the prior art of causing a distribution of the compressed gas evenly over the back of the mold before acting on the back of the mold, the gas furthermore having to be let off through a large number of openings in the pattern plate. These openings are however again likely to be the cause of trouble conditions inasfar as they become stopped up with mold making material.

GENERAL OUTLINE OF THE INVENTION

Taking this stage of development of the prior art as a starting point, one purpose or object of the present invention is that of designing a way of compacting mold material, which on the one hand makes do without any later mechanical pressing operation and on the other hand makes certain of an even compaction to the desired degree of the said material while at the same time producing a regular surface to the mold making material.

For effecting this purpose and further purposes, in the present invention the compressed gas undergoes expansion into the mold space up to a pressure of 8 bar at the most at a gas mass flow rate of greater than 50 kg/sec. and with a pressure increase rate in the mold space of more that 300 bar/sec. Because the pressure increase in the mold space from 1 bar to the maximum pressure firstly takes place at a low rate before increasing very steeply and is furthermore dependent on the pneumatic conditions, the said value as given of more than 300 bar/sec is produced in the mold space, the lowest value that may be measured being 1.5 bar.

In the known method of the said specification No. 1,961,234 this has, it is true, an account of an extreme case in which a pressure gradient of 516 bar/sec. is produced, this reading is however for the pressure drop in the inlet pressure space or anti-chamber, and in point of fact on taking into account the size of the valve opening and the mechanical design of the valve it will be seen that the pressure increase gradient in the mold space is very much less than 300 bar/sec. Moreover in this prior art method the figure that may be worked out for the gas throughput or flow rate is about 6 kg/sec., whereas in the invention, in the case of small mold flasks, the flow to be produced has to be at least 50 kg/sec. and with normal-sized flasks it has to be very much higher than 100 kg/sec. and a flow rate that is of the order of some hundreds of kilograms a second is needed in the case of large flasks. The production of an uneven surface on the mold making material is put to an end in the invention inasfar as the pressure increase in the mold space does not go over 8 bar, it being a very important point in connection with the compaction effect that the speed of pressure increase in the mold space is over 300 bar/sec., whereas the gradient of the pressure drop in the inlet pressure space is quite unimportant. Tests run under working conditions have made it clear that with the combination of these process engineering details the right degree of mold material compaction may be produced not only over the cross section of the mold space, but furthermore over the depth of the mold space while at the same time getting an even surface to the mold making material. The blow off holes for the compressed gas in the pattern plate are unnecessary or are only needed in the deep pockets in the surface of the pattern. The effect of the process of the invention may be seen from this not to be based on the fluidization, or at the most may only be based thereon to a small degree, and in fact the cause would seem to be a sort of piston effect of the gas and pressure build up effects within the mass of the mold making material.

Using the process of the invention a way is opened up of decreasing the pressure necessary in the inlet pressure space so as to be at the most only 20 bar. This pressure may be taken care of with a relatively uncomplex design of the plant, whereas in the prior art the pressure to be used of up to 100 bar made such a special design of the plant necessary that the process is of no commercial interest.

For undertaking the process, the invention is based on the use of a known apparatus (see the said German specification No. 1,961,234) having a pressure vessel forming the inlet pressure space, a flask that is placed thereunder forming the mold space and having a filling frame, and furthermore a pattern plate, forming the mold space floor, and having the pattern. There is furthermore a valve placed between the pressure vessel and the mold flask. The valve of the known apparatus is a plate valve, that has a partly pneumatic and partly mechanical backup drive, the valve shutting off an opening with a relatively small cross section between the pressure vessel and the flask. For stopping the compressed gas from acting on the surface of the mold material in the form of jets there is furthermore a distribution cone under the valve opening and thereunder a perforated plate stretching right over the full surface of the mold space or (in another form of the apparatus) an adjustable slotted plate (see German Offenlegungsschrift specification No. 2,151,949). With this apparatus it is not possible for the pressure gradient needed in the present invention of more than 300 bar/sec. in the mold space to be produced. As a further part of the invention this pressure increase is made possible inasfar as the opening cross section of the valve is equal to between 50 and 150% of the horizontal cross section of the mold flask, the valve having a closing valve member clearing the opening cross section in some milliseconds, for example in about 10 milliseconds. This may be made possible with a reasonable (that is to say limited) degree of design changes if the mass of the moving parts of the valve closing member is equal to about 100 kg/sq meter of the valve area. The desired figures may furthermore only be produced if the drive of the valve closing member is not coupled with the parts of the valve closing member that are responsible for shutting the valve.

A detailed account of some working examples of the invention, that give the desired function and keep to the design in the necessary respects, will now be given using the figures.

LIST OF DIFFERENT VIEWS OF THE FIGURES

DETAILED ACCOUNTS OF WORKING EXAMPLES OF THE INVENTION

The figures have generally been limited to those parts of the compacting apparatus that are necessary for the invention or are representative of the respects in which the invention is different to the prior art. More specifically the supports of the machines, the parts for lifting and lowering the mold flasks and filling frames and, if necessary, ejecting the finished molds from the flasks have not been detailed. Furthermore the figures do not give any details of the systems for putting the patterns in place and for filling the foundry sand into the flasks, seeing that all these parts are known to foundry engineers. Some details of the sand filling system are however to be seen in FIG. 2.

Figure 1:
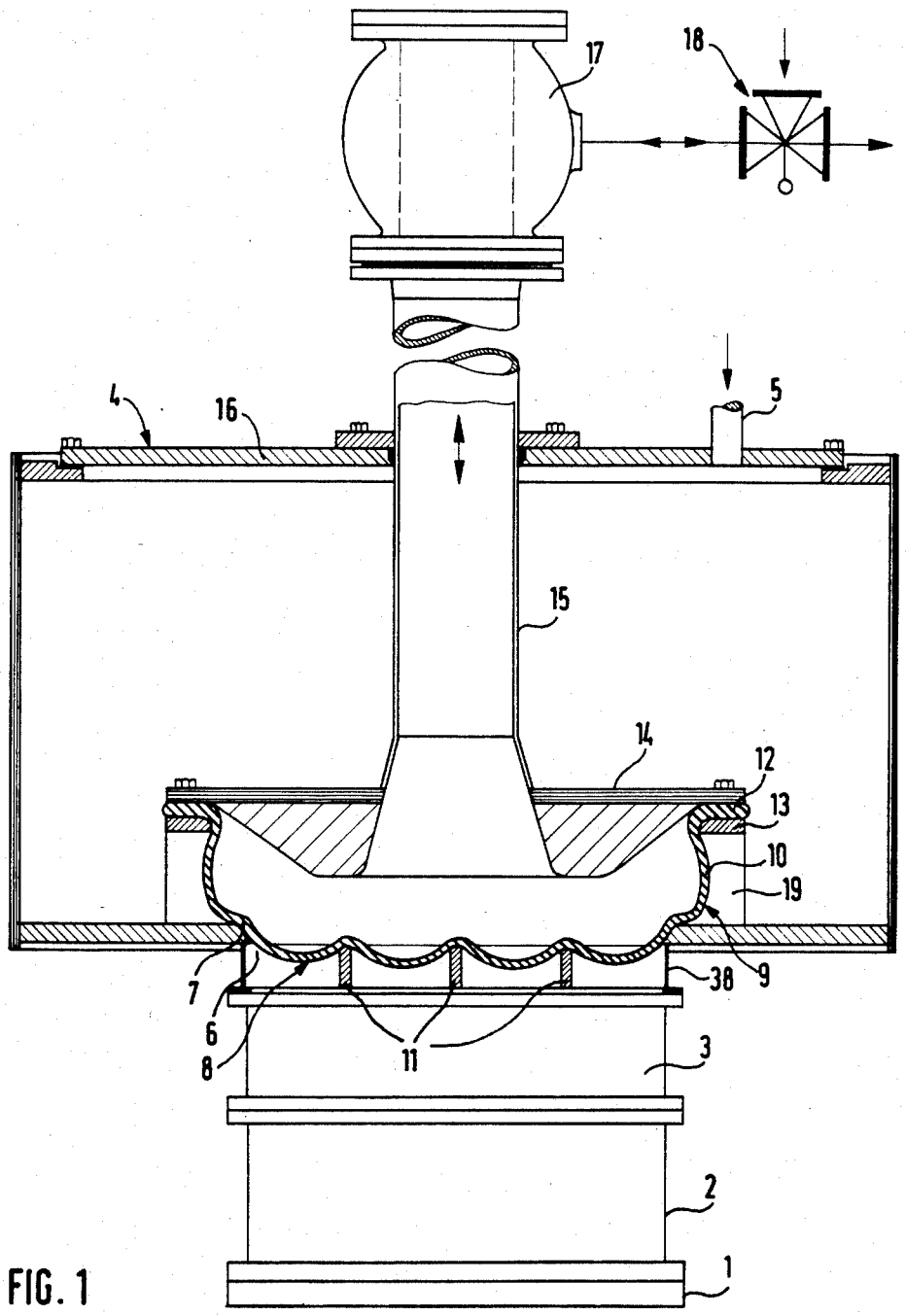
FIG. 1 is a diagrammatic view of the apparatus with the pressure vessel and the valve as seen in section as part of a first working example of the invention.

Referring now to FIG. 1, it will be seen that a pattern plate 1, whose pattern is not figured, has a mold flask 2 placed on it and that a filling frame 3 is put on the flask 2, these parts walling in the mold space. Over the mold space there is a pressure vessel 4 to take up compressed gas at a pressure of up to 20 bar by way of a union 5 from a pressure receiver or—if a low feed pressure is used—from the plant compressed air line system.

The pressure vessel 4 has an opening 6 that in the working example of FIG. 1 is placed in the middle of the lower wall or bottom thereof. The opening 6 has a clearance width generally equal to the free horizontal cross section of the filling frame 3. On the pressure vessel 4 there is a skirt 38 running down from the opening 6 and the unit made up of the pattern plate 1, the mold flask 2 and the filling frame 3 may be pushed upwards against the lower end of the skirt 38.

The edge 7 of the opening 6 takes the form of sealing seat for a valve that is generally numbered 8 and that has an elastic closing member 9 having a weight of less than 100 kg/meter of the valve area. In the special case of this working example of the invention the elastic closing member 9 is in the form of a diaphragm 10, that may be blown up or inflated like a bladder so that, in the inflated condition, it is seated or rested air-tightly against the edge 7 of the opening of the pressure vessel 4. Furthermore there are a number of support rails 11 placed within the skirt 38 so that the diaphragm 10 will be rested thereagainst in its inflated condition.

The diagram 10 has its edge 12 clamped in position some distance over the floor of the pressure vessel 4, this being done by a ring 13 that is spaced from and fixed to the floor and a plate 14, that is fixed on the ring 13 by screws so that the edge 12 of the diaphragm is clamped and gripped therebetween.

The plate 14 is kept in position by an upright tube 15 running down in the middle of the vessel 4 and fixed to the upper wall 16 or cover thereof. This tube 15 is a connection between the inner side of the diaphragm 10 and a gas supply pipe (not to be seen in the figure) for the air for causing shutting of the valve 8. Between this gas supply pipe and the diaphragm 10 there is a collapsing pipe valve 17 that may be shut by letting in air to its driving space by way of a three way valve 18. In the lower opening of the tube 15 there is a molding with smoothed over edges, against which the diaphragm 10 may be rested.

The driving air coming in by way of the tube 15 bends the diaphragm 10 outwards so that the diaphragm comes to rest against the edge 7 of the opening in an air tight manner. In this condition the pressure vessel 4 is filled with compressed gas up to a pressure of 20 bar. The mold unit made up of the mold flask and the filling frame is pushed against the lower edge of the skirt 38 on the pressure vessel 4. At the latest while the filling operation is still taking place, the collapsing tube valve 17 is shut down. The driving air acting on the collapsing tube valve 17 is then suddenly let off so that the collapsing tube valve is opened automatically by the effect of the pressure in the tube 15 so that the compressed gas in the pressure vessel 4, making its way through the ring-like cross section 19 between the ring 13 and the floor of the pressure vessel 4 has the effect of kicking the diaphragm back with the outcome that the diaphragm becomes forced against the outline of the molding at the lower end of the tube 15. The compressed gas is then able to undergo expansion out through the opening 6 into the mold space and have a compacting effect on the surface of the mold material. This compacting effect has the nature of a combined piston-like pressure wave and a fluidizing operation with a pressure build up.

The time taken for the opening of the diaphragm 10 is of the order of milliseconds if the cross section of the tube 15 and of the collapsing tube valve 17 are great enough. Furthermore the cross section for letting off the driving air from the collapsing tube valve has to be great enough. With this design a pressure gradient of over 300 bar/sec. may be produced.

Figure 2:
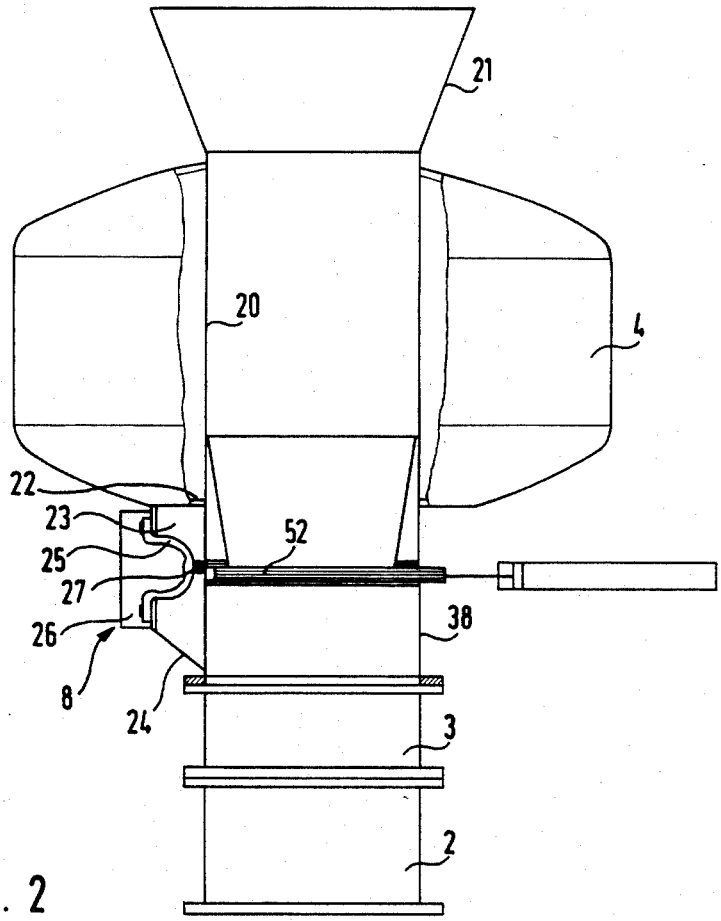
FIG. 2 is a view on the same general lines as FIG. 1 of a second working example of the invention.

While in the case of the example of the invention of FIG. 1 the mold making material has to be filled into the mold space at some position clear of the compacting station, the reader will see in FIG. 2 a working example, in the case of which a filling pipe 20 with a filling hopper 21 for the mold material is placed at a higher level than the mold space within the mold flask 2 and filling frame 3. The filling pipe 20 may be shut off from the mold space by way of a slide 52 or the like. Between the slide 52 and the filling space 3 there is a skirt 38 to the housing, this skirt 38 being longer in the axial direction than the skirt of FIG. 1. In this working example of the invention the pressure vessel 4 is designed in the form of a hollow ring or collar that is placed round the filling pipe 20 running downwards therethrough.

The pressure vessel 4 has a ring-like opening 22 that is concentric in relation to the filling pipe 20, so as to give a connection with a ring opening 23 at the slide 52. This ring opening 23 is placed only partly, but as far as possible round the filling pipe 20 and the skirt 38 and to take an example there may be a break in the opening on only one side to let the slide 52 be moved outwards. Between the ring opening 23 and the skirt 38 there is a cone-like part 24.

To the side of the ring opening 23, the valve 8 has a ring-like bellows 25 walling in a driving air duct 26 and separating it from the ring opening 23. Near the slide 52 there is furthermore a sealing seat 27 placed round the filling pipe 20, the seat being designed for use with the moving valve member in the form of the ring-like bellows 25. Using the driving air supplied by way of the duct 26 the ring-like bellows 25 is blown out and forced into the ring opening 23 so as to come to rest air tightly on the seat 27.

In the compacting operation the driving air is let off from the duct 26 so that the ring-like bellows 25 is forced back and bulged outwards under the effect of the compressed gas present.

For this reason the full cross section of the ring or annular space 23 is uncovered and freed for the expansion of the compressed gas so that same is now blasted into the skirt 38 and into the mold space.

Figure 3:
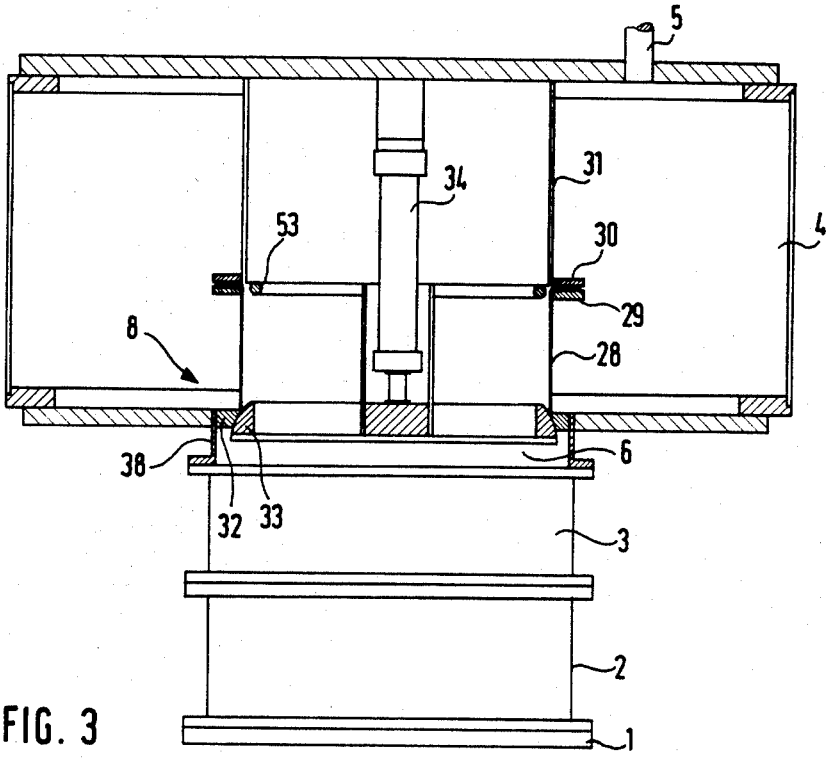
FIG. 3 is a like view of a third working form of the invention.

In the further form of the invention of FIG. 3 a length of pressure resistant flexible pipe 28 is clamped in position within the vessel 4 so that it is lined up with the axis of the said vessel. The lower end is sandwiched between a ring 29 and the flange 30 of a support tube 31. At the opening 6 ring-like seat 32 is fixed in position. The seat 32 becomes wider in a downward direction. Within the pipe 28 there is a gripping ring 33 that may be moved upwards and downwards by an upright actuator 34. In the lowered position thereof it is possible for the flexible pipe 28 to be taken up within the opening 6. On moving the gripping ring 33 upwards, the lower end of the flexible pipe 28 is gripped between the ring and the seat 32.

For starting the compacting of the mold making material the gripping ring 33 is lowered a bit so that the flexible pipe 28 is then forced inwards by the compressed gas in the pressure vessel 4, the same then being let off violently by way of the gripping ring 33 into the mold space 2 and 3. To get the imploded flexible pipe 28 back into its desired form there is a stripper ring 53, that is placed concentrically within the pipe 28 and that is lowered after expansion so that the flexible pipe 28 is forced outwards again so that its lower end is moved into the opening 6. Nextly the gripping ring 33 is moved upwards again so that the flexible pipe may be clamped in position as it was in the first place.

Figure 4:
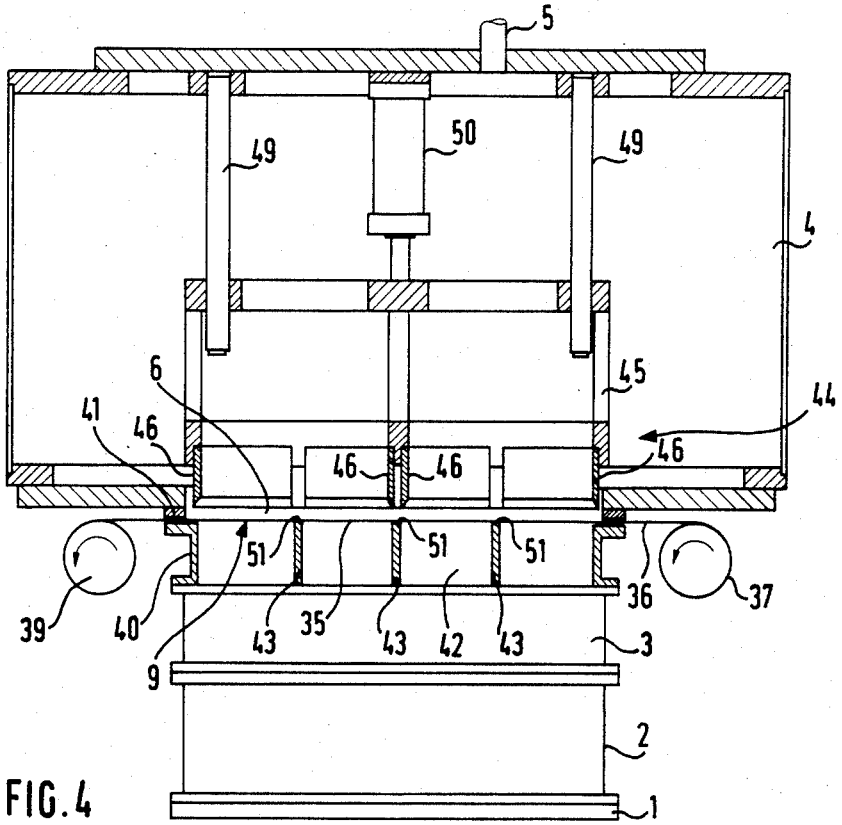
FIG. 4 is a view on the same lines as FIG. 1 of a fourth example of the invention.
Figure 5:
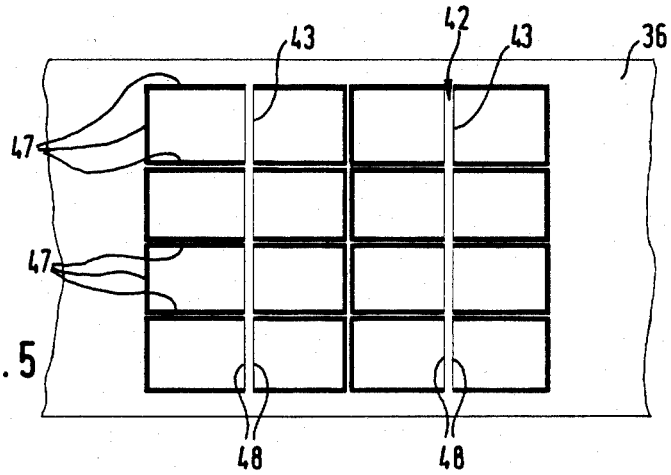
FIG. 5 is a plan view of the tearing elements of the invention's working example as in FIG. 4.

The example of the invention to be seen in FIGS. 4 and 5 has a valve or shut off member in the form of a diaphragm 35 that is cut up into pieces when opening takes place. This diaphragm 35 is supplied from a roll 37 of a running length or web of such material at 36. This running length is taken from the mold space walled in by the filling frame 3 and the flask 2, it being pulled off in lengths by way of a take-up roller 39. The running length 36 is moved between a collar 40 on the filling frame 3 and a sealing ring 41 at the opening 6 of the pressure vessel 4. The gap is sealed off on lifting the flask 2 by forcing the collar 40 against the running length of diaphragm.

Within the collar 40 there is grating 42 made up of rods 43 on which the diaphragm is supported. As will be seen from FIG. 5, the rods 43 of the grating are widely spaced from each other.

Over the opening 6 and within the pressure vessel 4 there is a cutter 44, that is made up of a grating-like frame 45 on which a number of cutting tools 46 are supported. These cutting tools have such a spacing between them that they may be used for cutting open or weakening the diaphragm along three sides of each opening of the grating. In FIG. 5 these cut lines are marked 47 and made somewhat thicker than the other lines in the figure. On one side 48 of each opening of the grating there is no cutting tool so that at such sides the cut out pieces of diaphragm are kept hinged to the rest of the running length of diaphragm 36. As may be seen from FIG. 5, there is no cutting of the diaphragm at the grating rods so that here there will be bridges of diaphragm joining up the flaps produced with the rest of the diaphragm 36.

The grating support or frame 45 of the cutter 44 is guided on rods 49 within the pressure vessel and may be moved upwards and downwards by an actuator 50 so that the cutting knives may be lowered out of the resting position to be seen in FIG. 4 onto the diaphragm that is to be cut up.

Before each compacting operation a new, uncut piece of the running length 36 is pulled into position between the mold space and the pressure vessel 4. Then the pattern plate 1, the mold flask 2, the filling frame 3 and the collar 40 are moved against the sealing ring 41 so that the running length of diaphragm is clamped against the pressure vessel 4. Then the pressure vessel 4 is filled with gas under pressure. When the desired feed pressure has been produced, the frame 45 with the cutters or tools 46 is moved downwards till the cutters are on the diaphragm 35, weakening it (at least) so that holes are produced in the diaphragm with a flap (FIG. 5) on one side of each such opening. When these openings are so made the full cross section of the opening 6 is suddenly freed so that the pressure in the mold space may be increased. After this compaction operation the mold space with the collar 40 is lowered so that a further, so far uncut, part of the endless length 36 may be pulled over the collar 40.

In place of the cutters acting like knives it is furthermore possible to have wires that are heated by an electric current in them. Such wires would be placed so as to be lined up with and over the rods 43 at 51 to take the place of the cutter 46. Because the diaphragm is tightly forced against the topsides of the grating rods 43 because of the effect of the compressed gas, there is a high heat transfer rate so that the elastic diaphragm is quickly weakened, along the sides where there are electrical heating wires, by melting, vaporization or burning of the material and openings are cut open in line with the pattern to be seen in FIG. 5. The heating wires may more specially be PTC elements, whose limiting temperature is only a little higher than the melting temperature of the diaphragm that is to be cut, so that this part of the apparatus is robust and thermally has self-controlling properties. In the two forms of the invention it is furthermore possible to make such changes that the cutters or the electrical heating wires are crossed over each other, it only being necessary to see that wide enough bridges or ribs are kept running in all directions.

Furthermore the electrical heating wires may be placed within the running length 36 of material, current being conducted thereto by way of the supply roll 37 and the take-up roll 39.

Figure 6:
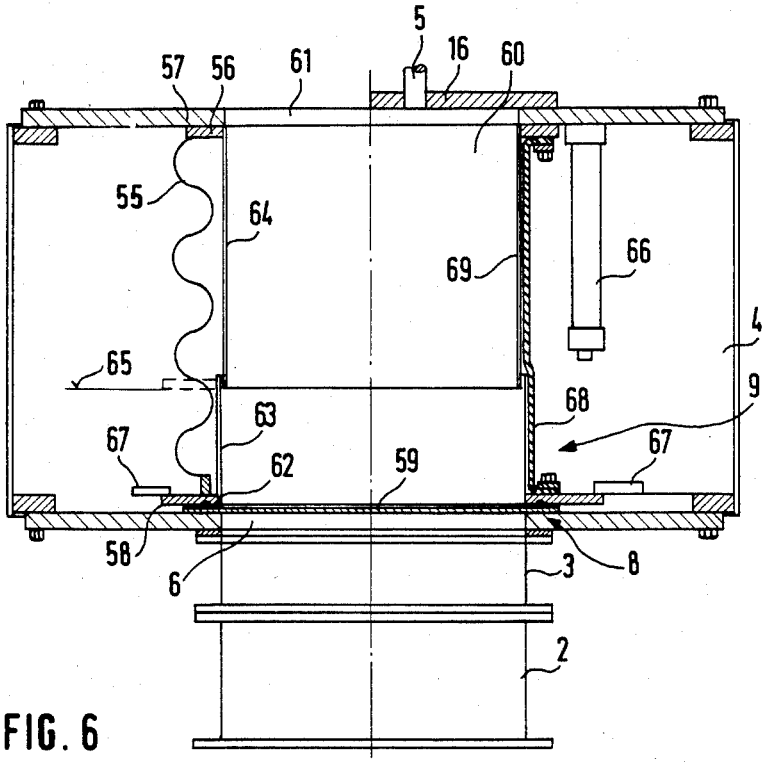
FIG. 6 is a lengthways section through two further forms of the invention.

In FIG. 6 the reader will see two further working examples of the invention, that are much like the structure to be seen in FIG. 3. On the left hand side of the figure there is a folding bellows 55 placed within the pressure vessel 4, one end 56 of the bellows 55 being fixed to the cover or upper wall 16 of the pressure vessel 4 by way of a ring 57. At the other end the folding bellows 55 has a flange 58 and this end is shut off by a diaphragm 59 or the like. The space 60 within the folding bellows 55 is joined up with the outside atmosphere by way of an opening 61 in the top wall 16 of the pressure vessel 4.

Between the flange 58 and the edge of the opening 6 a gasket 62 is positioned and it is fixedly joined to one of the two parts. At this end of the folding bellows 55 there is furthermore a support pipe 63. On the same lines there is at the top of the folding bellows 55 a support pipe 64 fixed to the top wall of the pressure vessel 4.

In the opened condition the flange 58 of the folding bellows 55 is roughly at the level 65, out of which it may be moved using an actuator 66 into the shut position that in the figure is marked in full lines, in which position it is then acted upon by a loading force. In this position a bolting apparatus (of which only two bolts are to be seen) takes effect against the flange 58. Before the start of a working operation the bolts 67 are undone so that the folding bellows may be lifted by the effect of the feed pressure and will then be speeded up under the effect of the compressed gas on the diaphragm 59 and moved into the level marked 65 with the outcome that the full cross section of the opening 6 will be suddenly uncovered and freed.

In the right hand half of FIG. 6 the working example will be seen to have a flexible pipe 68 in place of the folding bellows 55, such pipe being placed, at least in part, against a support pipe 69. Furthermore when the bolt 67 is moved out of its locking position the flexible pipe will be imploded under the elastic pre-stress and the gas pressure. In other respects the system is like the bellows to be seen on the left hand half of the figure, although however there is no longer support pipe 63.

Figure 7:
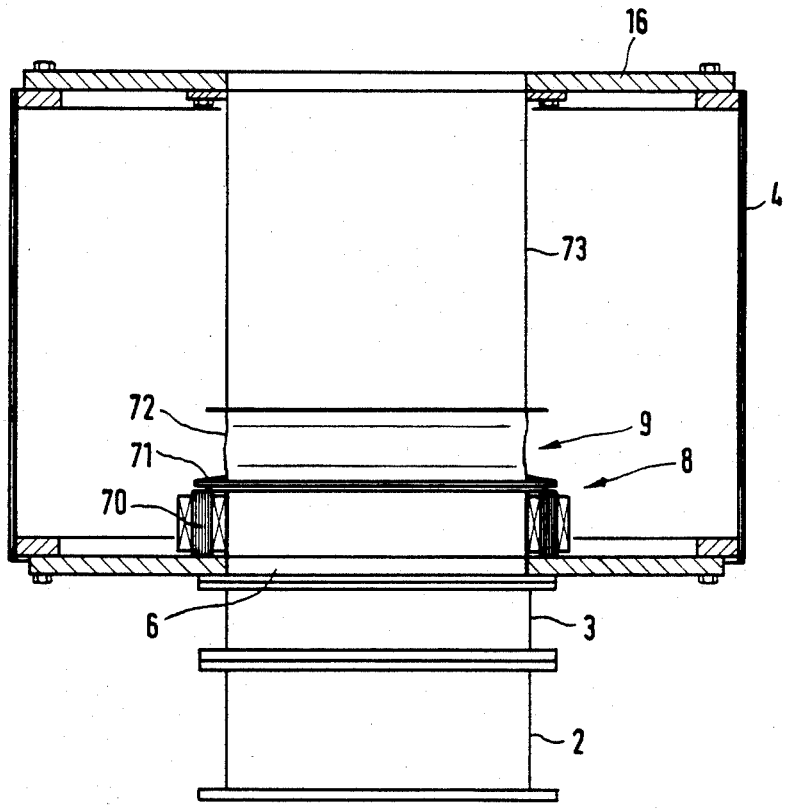
FIG. 7 is a view of a further somewhat changed form of the invention, in lengthways section.

In the working example of the invention to be seen in FIG. 7, the desired high-speed uncovering of the full cross section of the opening 6 is effected using an electrical surge discharge. The high forces and accelerations that are possible in such a case are used for example in reshaping metals (transploder technology), for producing high air speeds (plasma wind tunnel) and the like. Because such technology is known, only those details will be touched upon here that are directly important for the invention in connection with the engineering novelty thereof. The most important parts of the circuit needed in this respect are a capacitor, an inductance and a make and break contact system. When the last-named is open, the capacitor is charged and on shutting the switch a flux is induced.

It will be seen in FIG. 7 that the inductance is in the form of a primary winding or coil 70 placed round the opening 6 of the pressure vessel 4. On top of the primary winding 70 there is a valve plate 71 functioning as the secondary coil and made of an electrically conducting but non-magnetic material. The valve plate is placed at the lower end of an elastic support, as for example a rolling boot 72, that for its part is fixed to the lower end of an open support pipe 73. The sealing force necessary for operation of the valve is produced by the pressure present in the pressure vessel 4 and acting on the back side of the valve plate 71. When the capacitor is suddenly discharged a high flux is induced in the primary winding 70, this inducing in turn a voltage in the secondary winding, that is to say the valve plate 71, such voltage producing in the secondary coil, that does not have any turns of conductor, eddy currents. The forces of the secondary field is opposite to the that of the primary field and the valve plate 71 is pushed away from the primary coil. The size of this repulsion force is proportional to the rate of change in the induced flux. On lifting or repulsion of the valve plate 71 the full cross section of the opening is suddenly freed, such opening motion furthermore being supported and stepped up by the pressure acting on the lower face of the valve plate 71. Because of the open design of the support pipe 73 there is nothing stopping or slowing down motion of the valve plate 71.

In the working examples of the invention to be seen in FIGS. 3, 6 and 7 the closing member for the cross section of the opening is formed by the structures 28, 68 and 72 in the form of pieces of flexible pipe, that are kept in the shut position by a further part (33 in FIG. 3, 58 in FIG. 6 and 71 in FIG. 7) and are opened up only by the effect of the compressed gas (FIG. 3) or using it as a backup effect (FIGS. 6 and 7) after starting opening by way of a separate driving effect (55 in FIG. 6 or the tension of the flexible pipe 68 in FIG. 6 and 70, 71 in FIG. 7). FIGS. 3, 6 and 7 are only used as some of the possible examples of the such a system.

Figure 8:
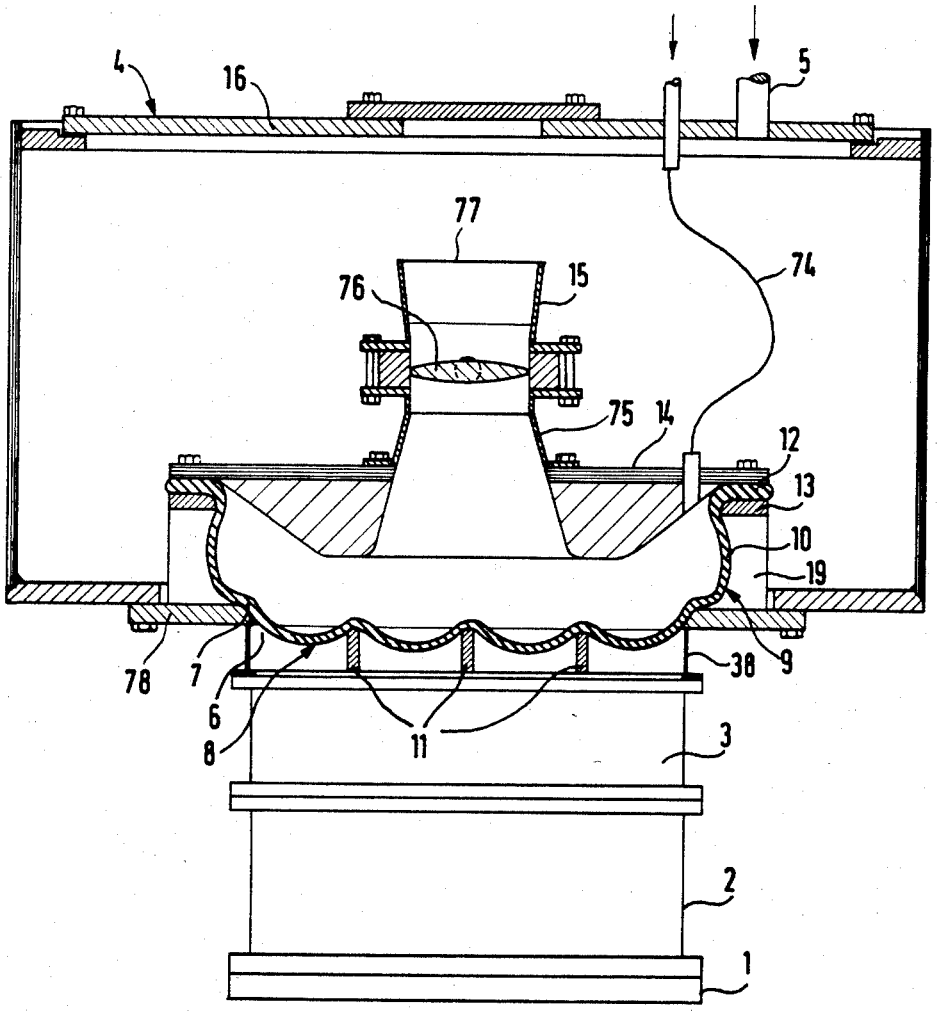
FIG. 8 is a view of a form of the invention on the same lines as FIG. 1, in lengthways section.

FIG. 8 is a view of a somewhat changed form of the system of FIG. 1. The present account will be limited to the parts of the system that are different to that of FIG. 1. In this case the controlling or driving air duct is made up of a simple pressure air hose 74 running through the pressure vessel 4 and opening by way of a connector into the space to be back of the diaphragm 10. This space is furthermore joined with a connector 75 for the inlet of air and which has a valve of some sort, as for example a butterfly valve 76. The air inlet connector 75 is joined with an opening 77 downstream from the butterfly valve 76, such opening being into the pressure vessel 4. The space to the back of the diaphragm is filled up by way of the compressed air hose 74 with gas that is compressed to a higher pressure than the gas in the pressure vessel 4 so that the diaphragm 9 is kept in its shut position. By opening the butterfly valve 76 the pressure in the pressure vessel 4 and in the space to the back of the diaphragm 9 will then become equal, the said diaphragm then being moved clear of its seat 7 or edge at the same time. This design of the invention is responsible for the highly useful effect that the amount of driving or controlling air and its energy, that is likely to be large, is not wasted but is used in the expansion process for causing the compaction of the mold making material. A design using this teaching is furthermore possible in the case of the form of the invention of FIG. 2. Because the elastic closing members are wearing parts, it is necessary to make such a design that they may be quickly taken out and new ones put in their place. For this reason in the working example of the invention of FIG. 8 the complete valve 8 with the parts 7, 9, 12, 13, 14, 75, 76 and possibly 11 are made as one assembly that may be quickly taken off using the high-speed replacement flange 78 from the pressure vessel 4 so that if the diaphragm 9 has become damaged a new one may be put in.

Figure 9:
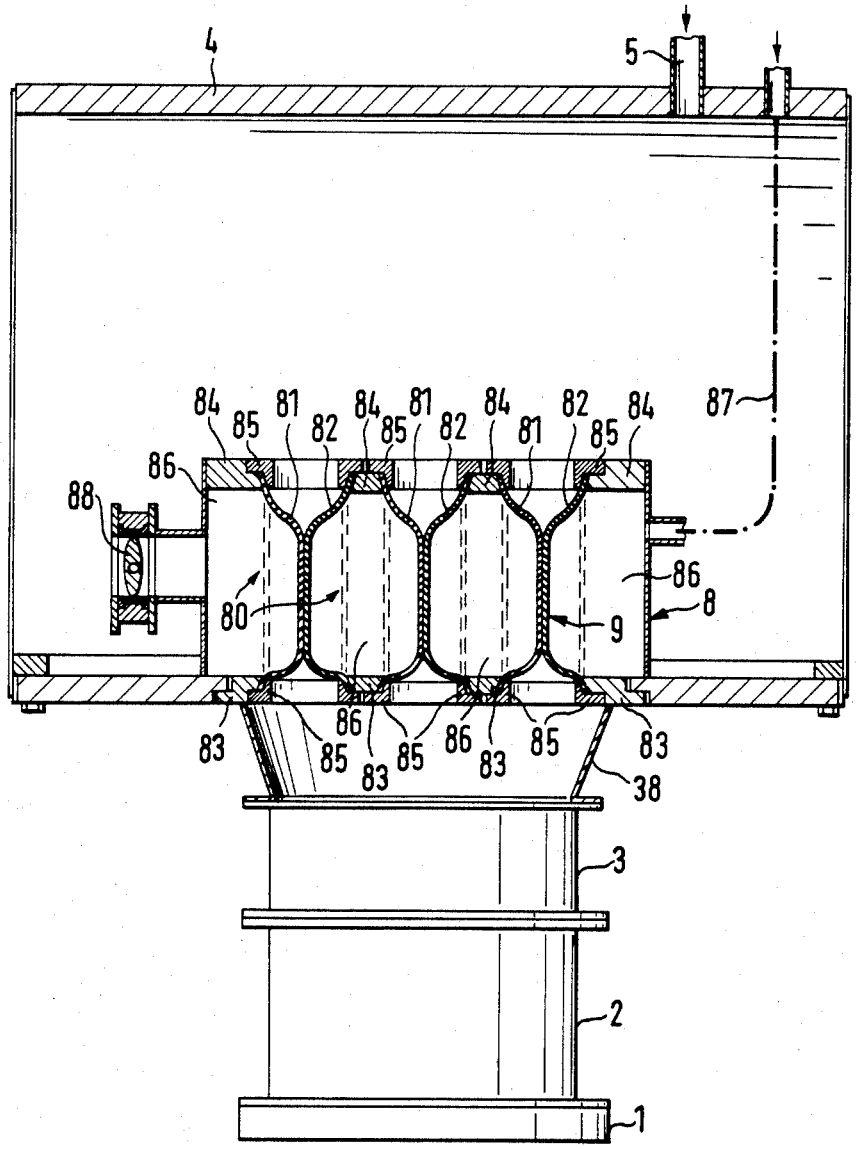
FIG. 9 is a view of a form of the invention based on the use of a collapsing tube valve.

In the further example of the invention of FIG. 9 the closing member 9 is made up of a number of diaphragms 80 placed back to back and which in the opening condition as marked in broken lines are generally parallel to the axis of the opening 6. Each pair of diaphragms 81 and 82 is clamped in place between lower rails 83, running across the opening 6 of the pressure vessel 4, and top rails 84, that are placed over and in line with the lower rails 83. Such clamping on the rails 83 and 84 is effected by gripping rails 85. Between the rails 83 and the rails 84 there is a great enough opening cross section. Between the two diaphragms 81 and 82 of each diaphragm pair spaces are formed, that are joined up together and with a control air line 87. Furthermore the spaces 86 are joined up with a butterfly valve 88, by way of which the control compressed air may be let off into the pressure vessel 4. The workings of the system are largely the same as in the working example of the invention of FIG. 8, but for the fact that the valve closing system of parts is closed by forcing the opposite diaphragms against each other.

Figure 10:
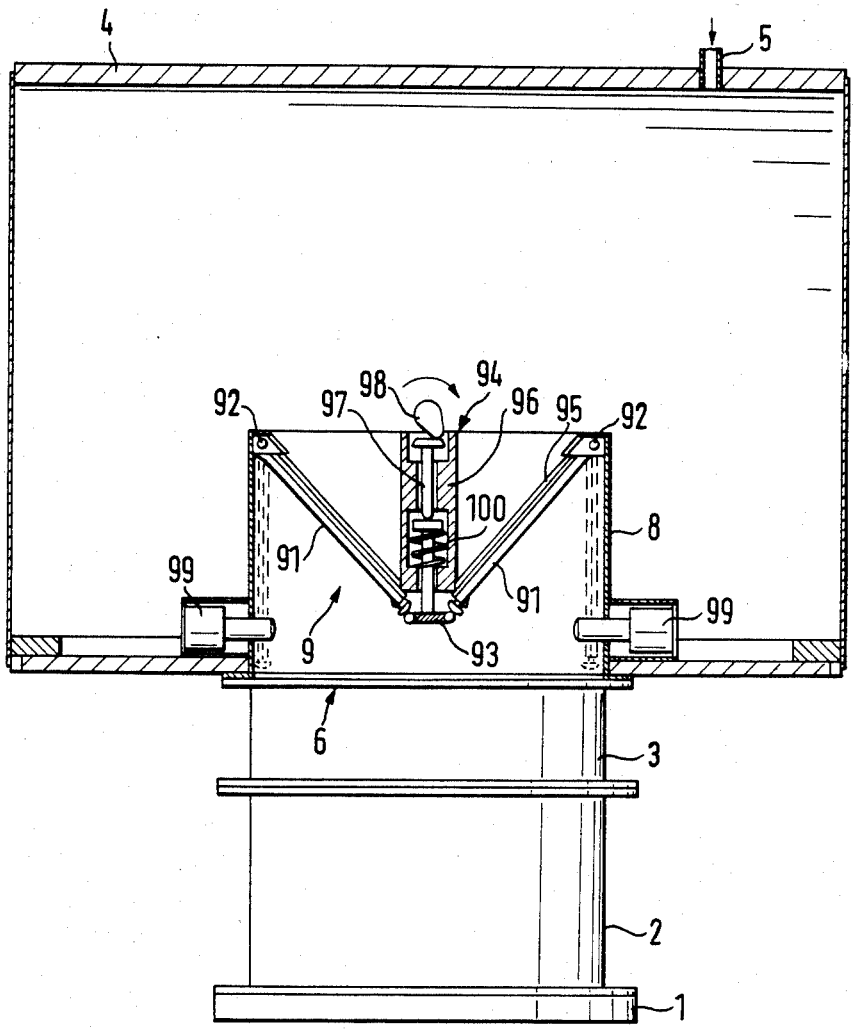
FIG. 10 is a view of a form with valve doors.

In FIG. 10 a different design of valve 8 is used. The closing member 9 is made up of two flaps 91, that are positioned over the opening 6 so as to be facing each other and turned towards the opening at a slope. The flaps 91 are supported at their top edges, that are further away from each other, by hinges 92, and at their lower edges, that are nearer together, they are supported by a beam 93 of a support 94 in the shut position of the valve. Each flap has a seal 95 running round it. By lowering the beam 93 using a plunger 97 (that is guided in a housing 96 of the support 94 and is moved by a cam 98) the flaps are unlocked and kicked open by the effect of the compressed gas in the pressure vessel 4 so that they go into the positions marked in broken lines, in which their kinetic energy is absorbed by dashpots 99. The shutting motion may be produced by normal components, as for example springs, air actuator cylinders or the like whereas locking of the flaps in the shut positions is effected by springs 100. In order to keep down the inertia of the moving parts as far as possible, the flaps 91 will be made for example of a frame of high-strength metal alloy with a foil synthetic resin stretched across, such resin or plastic being for example polyethylene.

Figure 11:
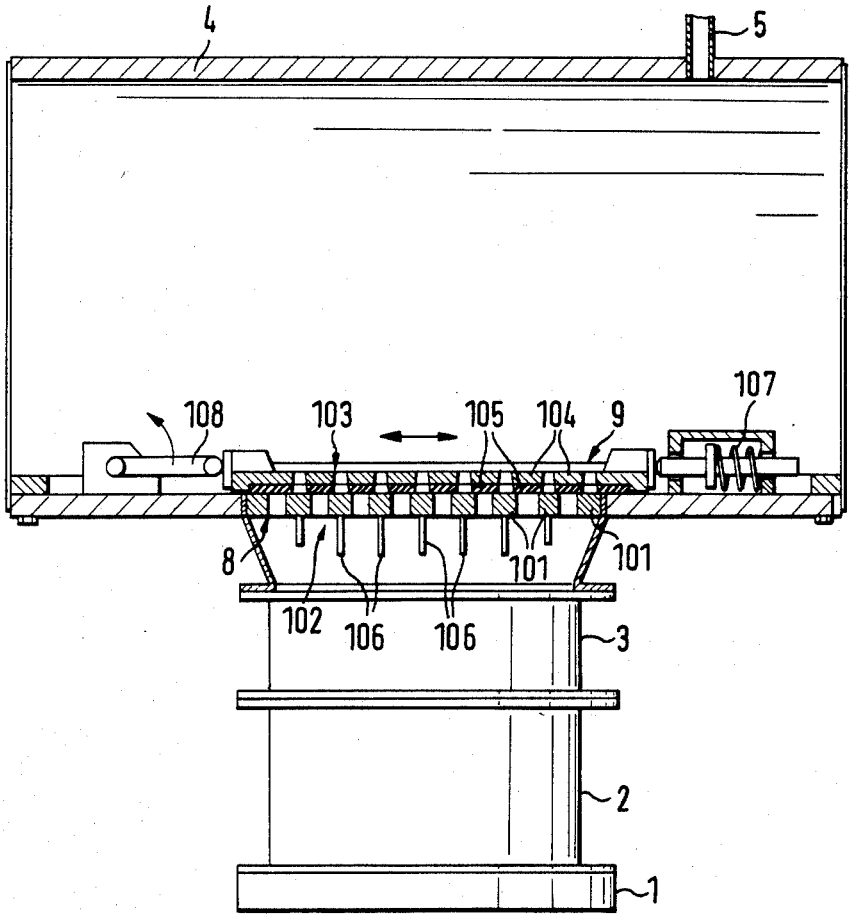
FIG. 11 is a view of a design using a sliding grating.

In the example of the invention to be seen in FIG. 11 the opening 6 of pressure vessel 4 has the rods 101 of a fixed grating 102 running across it. Over the grating 102 there is a sliding grating 103, whose rods 104 are coated with a sealing material as for example low pressure polyethylene 105 on the side facing the grating 102. The rods 101 of the fixed grating 102 are supported furthermore by ribs 106 to take up static forces. The sliding grating 103 is acted upon by spring 107 and is locked in the shut position to be seen in FIG. 11 by a locking lever 108. By rocking the lever 108 in an upward direction the locking function is overcome and the sliding grating kicked over into the open position thereof, wherein the rods 104 of the grating 103 are over and lined up with the rods 101 of the lower grating 102. As the sliding rod comes into this position it is braked and slowed down by dampers, not to be seen in the figure. The sliding grating may be moved again by a known system till the locking lever 108 may be moved into its locked position.

We claim:

1. An apparatus for compacting foundry mold making material, comprising a pressure vessel, a mold flask placed thereunder with a filling space therein, a pattern support plate forming a floor of said space, and a valve placed between the pressure vessel and the mold space, said apparatus being designed for causing expansion of said compressed gas out of said pressure vessel into said mold space as far as a pressure of 8 bar at the most with a gas throughput rate of more than 50 kg/sec and with a pressure increase rate in the said mold space of more than 300 bar/sec, the opening cross section of said valve being between 50% and 150% of the horizontal cross section of the inside of the flask, and wherein said valve has an elastically deforming closing member designed to be moved clear of the desired opening cross section mostly by the effect of pressure in the said pressure vessel.

2. The apparatus as claimed in claim 1 wherein the elastic valve closing member is a diaphragm designed in a shut position thereof to be rested against the edge of the said opening in the pressure vessel so as to make a sealing joint.

3. The apparatus as claimed in claim 2 wherein said diaphragm is gripped at its edge by part of said apparatus to be in a position over the said opening with said pressure vessel so that a ring-like pressure flow cross section is formed, said diaphragm being designed to be bulged outwards in a shut position thereof by driving air acting on an inner side of the diaphragm, said outwardly bulged diaphragm then resting against the edge of the opening of the pressure vessel.

4. The apparatus as claimed in claim 3 wherein a space is shut in on the said inner side of diaphragm, said apparatus further having a driving air line joined with said inner side space, and a valve for shutting off said air line.

5. The apparatus as claimed in claim 1 wherein said closing member is made up of a a number of elastic diaphragm panels placed parallel to each other and to an axis of said opening, two of said panels in each case limiting a part of the cross section of the opening and able to be moved by compressed air into positions shutting off said opening.

6. The apparatus as claimed in claim 5 having in said opening a number of parallel upper narrow bars are placed and spaced therefrom a further group of spaced bars, the diaphragms being placed in pairs back to back with top ends thereof joined to one of the said upper bars and with lower ends thereof joined to one of the bars in said further group walling off a space between each such pair into which said compressed air for causing outward bulging of said diaphragms in said pair may be run.

7. The apparatus as claimed in claim 6 wherein said spaces between such pairs of diaphragms are joined together and to a common compressed air line for ganged operation of said panels.

8. The apparatus as claimed in claim 2 wherein said diaphragm is designed to be parted and is fixed in position between the mold flask and the pressure vessel.

9. The apparatus as claimed in claim 8 wherein the said diaphragm has lines of weakness for the purpose of uncovering the opening, said lines of weakness being placed at defined positions so that on rupturing of said lines of weakness under the effect of the compressed gas the diaphragm is kept in one piece.

10. The apparatus as claimed in claim 9 having a grating with widely spaced grating bars under the opening of the diaphragm for supporting it in the opening of the pressure vessel and before rupturing of the diaphragm and uncovering of the opening the same is only weakened along three sides of each opening of the grating.

11. The apparatus as claimed in claim 10 wherein over the diaphragm that is designed to be ruptured there is a cutting tool, whose cutting edges are so placed in line with the openings of the grating that it is only at three sides of each grating opening that there are cutting edges.

12. The apparatus as claimed in claim 11 wherein the cutting tool is placed on a grating frame that is guided for sliding motion in the pressure vessel.

13. The apparatus as claimed in claim 10 wherein the bars of the grating have conductors at top sides thereof that are able to be electrically heated, such conductors only being placed round three sides of each grating opening and being able to be turned on for uncovering said opening by melting said diaphragm material.

14. The apparatus as claimed in claim 10 wherein wires, that are able to be electrically heated are embedded in the diaphragm and may be turned on for uncovering the opening.

15. The apparatus as claimed in claim 14 wherein the diaphragm that is designed to be ruptured is a part of a running length of elastic web, that is taken from a supply roll on one side of the mold flask in step with operation of the apparatus and may be pulling taken up on an opposite side of the apparatus.

16. The apparatus as claimed in claim 1 wherein said closure member has a flexible pipe whose axis is parallel to the axis of the opening and whose cross section is designed to be in line with the cross section of the opening of the pressure vessel, one end of the flexible pipe being fixed spacedly over and within the opening of the pressure vessel whereas an opposite end of the said flexible pipe is placed running into the opening and having a system for pressing it against an edge of the opening for functioning as the valve.

17. The apparatus as claimed in claim 16 having a sealing seat, becoming wider towards the mold flask, on the said edge of the opening, said pressing system having a gripping ring that may be moved upwards for gripping the end of the flexible pipe against the sealing seat.

18. The apparatus as claimed in claim 17 wherein the gripping ring has an actuator for moving it upwards and downwards, said actuator being placed in said pressure vessel.

19. The apparatus as claimed in claim 18 having a stripping ring placed over and within the flexible pipe and that is able to be lowered to a position near the sealing set after the opening has been uncovered.

20. The apparatus as claimed in claim 1 wherein the valve closing member is in the form of a folding bellows having its axis lined up with the axis of the opening and having one end thereof fixed in the pressure vessel whereas a further end thereof is locked in the shut position of the valve over the edge of the opening and is shut off.

21. The apparatus as claimed in claim 20 wherein said bellows has a flange at its end nearest to the opening and has a locking system for acting against the outside of the flange, the said end of the bellows furthermore having a diaphragm shutting it.

22. The apparatus as claimed in claim 21 having an actuator for moving the bellows into its shut position.

23. The apparatus as claimed in claim 22 wherein the inside of the bellows is joined up with the outside atmosphere.

24. The apparatus as claimed in claim 23 having support tubes within the bellows, one of such tubes being joined up with that end of the bellows that is nearest to the opening.

25. The apparatus as claimed in claim 20 wherein the place of the bellows is taken by a flexible tube.

26. The apparatus as claimed in claim 20 wherein the bellows is pre-stressed into the shut position of the valve.

27. The apparatus as claimed in claim 2 wherein the driving air for the diaphragm for starting is opening motion undergoes expansion into the pressure vessel.

28. The apparatus as claimed in claim 2 wherein the valve and parts supporting it are in the form of a single assembly that may be taken from the pressure vessel and a new one put in its place.

29. An apparatus for compacting foundry mold making material, comprising a pressure vessel, a mold flask placed thereunder with a filling space therein, a pattern support plate forming a floor of said space, and a valve placed between the pressure vessel and the mold space, said apparatus being designed for causing expansion of said compressed gas out of said pressure vessel into said mold space as far as a pressure of 8 bar at the most with a gas throughput rate of more than 50 kg/sec and with a pressure increase rate in the said mold space of more than 300 bar/sec, the opening cross section of said valve being between 50% and 150% of the horizontal cross section of the inside of the flask, wherein said valve closing member has a weight of less than 100-0 kg/sq meter of the valve area, and wherein the apparatus has a middle filling passage for mold making material, a slide for shutting the passage off from the mold flask that is placed thereunder, the valve having a ring-like opening round the passage and producing the connection between the pressure vessel and a space between the slide and the mold flask, and a ring-like seat means on an inner wall face of the ring-like opening, and a ring-like bellows able to be pressed against the outer wall of the ring-like opening at the seat means.

30. The apparatus as claimed in claim 29 wherein the pressure vessel is placed like a ring round the filling passage, it opening by way of a ring-opening into the said ring-like opening.

31. The apparatus as claimed in claim 29 wherein the ring-like bellows is kept in the shut position by driving air.

32. The apparatus as claimed in claim 29 wherein the driving air for the ring-like bellows for starting its opening motion undergoes expansion into the pressure vessel.

33. An apparatus for compacting foundry mold making material, comprising a pressure vessel, a mold flask placed thereunder with a filling space therein, a pattern support plate forming a floor of said space, and a valve placed between the pressure vessel and the mold space, said apparatus being designed for causing expansion of said compressed gas out of said pressure vessel into said mold space as far as a pressure of 8 bar at the most with a gas throughput rate of more than 50 kg/sec and with a pressure increase rate in the said mold space of more than 300 bar/sec, the opening cross section of said valve being between 50% and 150% of the horizontal cross section of the inside of the flask, wherein the pressure vessel has an opening that is generally the same in form and size as the outline of the mold flask, the flask and a filling frame being able to be pressed against an edge of said opening to make a sealing joint, said edge of said opening having the valve closing member seated against it, and wherein said valve has two flaps that are placed at an equal slope in relation to the plane of the opening, said flaps being kept in shut positions thereof at lower edges thereof by a common lock that may be unlocked, whereas top edges of the flap are hinged in position.

34. The apparatus as claimed in claim 33 having a beam able to be lifted and lowered for locking the lower edges of the flaps in shut positions thereof.

35. An apparatus for compacting foundry mold making material, comprising a pressure vessel, a mold flask placed thereunder with a filling space therein, a pattern support plate forming a floor of said space, and a valve placed between the pressure vessel and the mold space, said apparatus being designed for causing expansion of said compressed gas out of said pressure vessel into said mold space as far as a pressure of 8 bar at the most with a gas throughput rate of more than 50 kg/sec and with a pressure increase rate in the said mold space of more than 300 bar/sec, the opening cross section of said valve being between 50% and 150% of the horizontal cross section of the inside of the flask, wherein the pressure vessel has an opening that is generally the same in form and size as the outline of the mold flask, the flask and a filling frame being able to be pressed against an edge of said opening to make a sealing joint, said edge of said opening having the valve closing member seated against it, and wherein the apparatus has a fixed grating in the opening, a further sliding grating placed thereover, a spring loading the same in its plane, and a locking system for keeping the sliding grating in a shut position thereof so that after being unlocked it may be moved by spring force into the opening position thereof.

36. The apparatus as claimed in claim 35 wherein said sliding grating has a sealing, wear-resistant material on the side thereof facing the fixed grating, such material being in the form of bars.

37. An apparatus for compacting foundry mold making material, comprising a pressure vessel, a mold flask placed thereunder with a filling space therein, a pattern support plate forming a floor of said space, and a valve placed between the pressure vessel and the mold space, said apparatus being designed for causing expansion of said compressed gas out of said pressure vessel into said mold space as far as a pressure of 8 bar at the most with a gas throughput rate of more than 50 kg/sec and with a pressure increase rate in the said mold space of more than 300 bar/sec, the opening cross section of said valve being between 50% and 150% of the horizontal cross section of the inside of the flask, and wherein said valve has a closing member designed to be moved clear of the desired opening cross section mostly by the effect of pressure in the said pressure vessel.

38. An apparatus for compacting foundry mold making material, comprising a pressure vessel, a mold flask placed thereunder with a filling space therein, a pattern support plate forming a floor of said space, and a valve placed between the pressure vessel and the mold space, said apparatus being designed for causing expansion of said compressed gas out of said pressure vessel into said mold space as far as a pressure of 8 bar at the most with a gas throughput rate of more than 50 kg/sec and with a pressure increase rate in the said mold space of more than 300 bar/sec, the opening cross section of said valve being between 50% and 150% of the horizontal cross section of the inside of the flask, and wherein the pressure vessel has an opening that is generally the same in form and size as the outline of the mold flask, the flask and a filling frame being able to be pressed against an edge of said opening to make a sealing joint, said edge of said opening having the valve closing member seated against it, and wherein the valve has a valve plate forming the secondary coil of a surge discharge circuit, whose primary coil is placed round the opening of the pressure vessel and is formed with a sealing seat for the valve plate.

39. The apparatus as claimed in claim 38 wherein the valve plate has a coaxial flexible pipe-like structure elastically supporting it hangingly.

* * * * *